US005468312A

United States Patent [19]

Martin et al.

[11] Patent Number: 5,468,312

[45] Date of Patent: Nov. 21, 1995

[54] IGNITION-SENSITIVE LOW-VULNERABILITY PROPELLENT POWDER

[75] Inventors: Bernard Martin, Ballancourt; Alain Lefumeux, Orsay, both of France

[73] Assignee: Societe Nationale des Poudres et Explosifs, Paris Cedex, France

[21] Appl. No.: 267,159

[22] Filed: Jun. 28, 1994

Related U.S. Application Data

[63] Continuation of Ser. No. 24,708, Mar. 1, 1993, abandoned.

[30] Foreign Application Priority Data

Mar. 11, 1992 [FR] France ..... 92 02879

[51] Int. Cl.[6] ..... C06B 45/10

[52] U.S. Cl. ..... 149/19.4; 149/19.1; 149/19.5; 149/19.6; 149/19.7; 149/19.9

[58] Field of Search ..... 149/19.4, 19.6, 149/19.1, 19.9, 19.7, 19.5

[56] References Cited

U.S. PATENT DOCUMENTS

| | | | |
|---|---|---|---|
| 3,156,594 | 11/1964 | Horton | 149/19 |
| 3,454,437 | 8/1969 | Yamazaki et al. | 149/21 |
| 3,653,993 | 4/1972 | Batchelder et al. | 149/19 |
| 4,269,637 | 5/1981 | Flanagan | 149/19.4 |
| 4,472,214 | 9/1984 | Flanagan et al. | 149/19.6 |
| 4,726,919 | 2/1988 | Kristofferson et al. | 149/19.4 |
| 4,917,019 | 4/1990 | Beltz | 102/470 |
| 4,919,737 | 4/1990 | Biddle et al. | 149/19.5 |
| 4,923,536 | 5/1990 | Canterberry et al. | 149/19.4 |
| 4,925,503 | 5/1990 | Canterberry et al. | 149/19.4 |
| 4,938,813 | 7/1990 | Eisele et al. | 149/19.4 |
| 5,024,708 | 6/1991 | Gast et al. | 149/19.1 |
| 5,139,587 | 8/1992 | Strecker et al. | 149/19.9 |
| 5,143,566 | 9/1992 | Strecker et al. | 149/19.9 |
| 5,189,247 | 2/1993 | Andre et al. | 149/19.4 |
| 5,210,153 | 5/1993 | Manser et al. | 149/19.6 |
| 5,223,056 | 6/1993 | Ahad | 149/19.6 |
| 5,316,600 | 5/1994 | Chan et al. | 149/19.4 |
| 5,348,596 | 9/1994 | Goleniewski et al. | 149/19.6 |

FOREIGN PATENT DOCUMENTS

A284418 11/1952 Switzerland .

OTHER PUBLICATIONS

*Chemical Abstracts*, vol. 115, No. 2, 15 Juillet 1991, Columbus, Ohio US; abstract No. 11884k, S. M. Shen et al. "Evaluation method for the effect of salts on the elimination of secondary flames of energetic materials by differential scanning calorimetry." p. 183; abstract from *Thermochim. Acta*, vol. 177, 1991, pp. 23–37.

*Chemical Abstracts*, vol. 115, No. 12, 23 Sep. 1991, Columbus, Ohio, US; abstract No. 117382k, T. K. Liu et al. "Effect of boron particle surface coating on combustion of solid propellants for ducted rockets.", p. 165; Abstract from *Propellants, Expols., Pyrotech.*, vol. 16, No. 4, 1991, pp. 156–166.

*Chemical Abstracts, vol. 84, No. 18, 3 May 1976, Columbus, Ohio, US; abstract No. 124121u, A. P. Glazkova et al. "Possible routes to increase the safety of safety explosives.", p. 136; Vzryvnoe Delo, vol. 75, 1975, pp. 190–203.*

*Primary Examiner*—Edward A. Miller
*Attorney, Agent, or Firm*—Bucknam & Archer

[57] ABSTRACT

The present invention relates to low-vulnerability propellent powders for weapons. The powders according to the invention consist of at least one organic nitro compound and an organic binder and are characterized in that they contain at least one additive chosen from the group consisting of lithium fluoride, ammonium fluoride and lithium nitrate, optionally in the presence of acetylene black. The powders according to the invention exhibit good ignition characteristics while retaining low vulnerability to impacts and to thermal shocks.

9 Claims, 1 Drawing Sheet

IGNITION-SENSITIVE LOW-VULNERABILITY PROPELLENT POWDER

This application is a continuation of U.S. Ser. No. 024,708 filed Mar. 1, 1993, now abandoned.

The present invention relates to the field of propellent powders for weapons. More precisely, the invention relates to a propellent powder which consists chiefly of an energetic filler and of a binder and which exhibits both a low vulnerability and good sensitivity to ignition.

Traditional ammunition filled with powders based on nitrocellulose and optionally nitroglycerine have the major disadvantage of being highly sensitive to thermal shocks and to projectile impact. Their storage aboard enclosed and insulated fighting vehicles such as armoured vehicles, combat aircraft or fighting ships therefore presents severe safety problems.

Attempts have been made to overcome this problem by developing a new generation of propellent powders for this ammunition, which are less sensitive to projectile impact and to thermal shocks. Powders of this kind, known as "low vulnerability" powders consist essentially of an energetic filler such as RDX or HMX and of a binder, of organic polymer type such as, for example, a polyurethane or a polyester. Such powders are described, for example, in French Patents 2,159,826 and 2,577,919 or in their equivalents GB 1,358,886 and U.S. Pat. No. 4,657,607.

Organic cellulose derivatives such as cellulose acetobutyrate, the use of which makes it necessary for a solvent to be present, can also be employed as a binder. Such compositions are described, for example, in U.S. Pat. No. 4,842,659.

These powders exhibit a good resistance to impact and to thermal shocks and make it possible to obtain ammunition of reduced hazard, also known under the acronym "LOVA" (Low Vulnerability Ammunition), but exhibit a new disadvantage: they are also relatively insensitive to ignition and as a result present some difficulties in use.

A person skilled in the art is therefore searching for propellent powders which exhibit both low vulnerability and good ignition characteristics at the same time.

The object of the present invention is precisely to provide such propellent powders.

The invention relates therefore to propellent powders for weapons, comprising an energetic filler consisting of at least one organic nitro compound and a binder consisting of at least one organic polymer, which are characterised in that they contain at least one additive chosen from the group consisting of lithium fluoride, ammonium fluoride and lithium nitrate.

The said energetic filler is preferably a nitramine chosen from the group consisting of RDX, HMX, nitroguanidine and triaminoguanidine nitrate.

According to a first embodiment of the invention, the binder is an inert binder, chosen preferably from the group consisting of crosslinkable binders such as polyurethanes or polyesters, or of thermoplastic binders such as thermoplastic cellulose derivatives such as cellulose acetobutyrate.

According to a second embodiment of the invention, the binder is an energetic binder chosen from the group consisting of the polyurethanes obtained from glycidyl azide polymers or copolymers.

The weight content of additive in the powder is generally between 0.5% and 3% relative to the combined constituents of the powder; this content is preferably around 1% by weight.

According to a preferred alternative form of embodiment of the invention, the additive is lithium fluoride.

According to another alternative form of the invention the additive is used in combination with acetylene black.

The weight content of acetylene black in the powder is preferably between 0.05% and 0.5% relative to all the constituents of the powder.

It has surprisingly been observed that the powders according to the invention exhibit good ignition characteristics while having an insensitivity to projectile impact which is not only equivalent to that of low-vulnerability powders containing the same energetic filler and the same binder without any additive according to the invention, but which is even further improved in this respect.

BRIEF DESCRIPTION OF THE DRAWING

A detailed description of implementation of the invention is given below with reference to FIG. 1 which illustrates the behaviour of certain powders according to the invention in the so-called hot ball test, compared with that of two homologous powders containing no additive according to the invention.

The invention relates to low-vulnerability propellent powders consisting of an energetic filler and of a binder.

Figure 1:
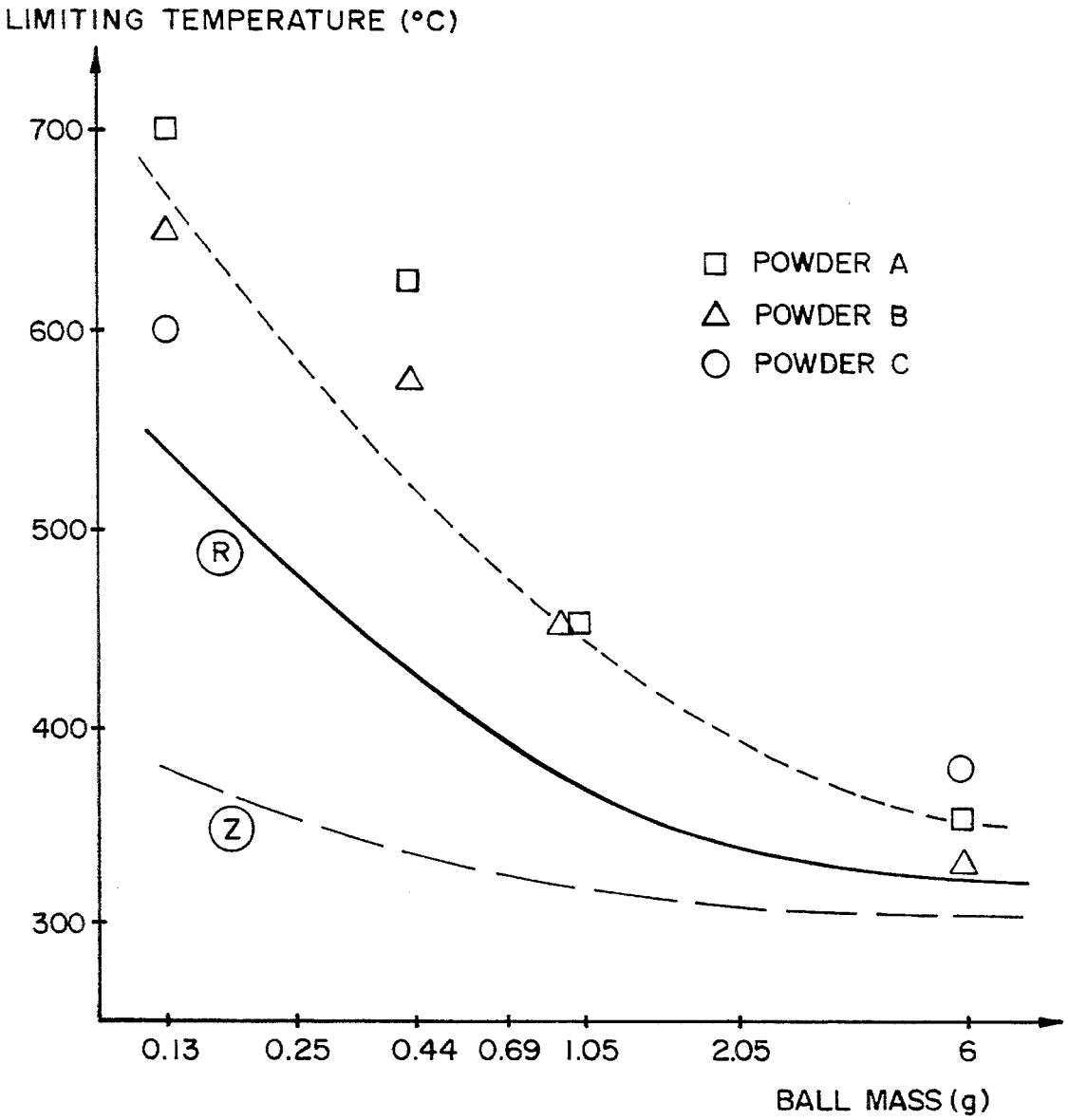

The energetic filler consists of at least one organic nitro compound which is preferably a nitramine chosen from the group consisting of RDX, HMX, nitroguanidine or triaminoguanidine nitrate.

The binder consists of at least one organic polymer. An inert binder or an energetic binder may be employed within the scope of the present invention.

The inert binder employed may be either a crosslinkable binder such as a polyurethane or a polyester, or a thermoplastic binder and especially a thermoplastic cellulose derivative binder such as cellulose acetobutyrate. In the case of crosslinkable binders, those obtained from a polybutadiene containing OH hydroxyl functional groups are particularly preferred.

The energetic binder employed may be polyurethanes obtained from hydroxylated polymers or copolymers of glycidyl azide and in particular from polyglycidyl azides.

In general the weight ratio binder: energetic filler will be around 20:80.

According to an essential characteristic of the invention the powder contains at least one additive chosen from the group consisting of lithium fluoride, ammonium fluoride and lithium nitrate.

It is the presence of at least one of these additives that gives the powders for weapons according to the invention their good ignition characteristics while retaining their low vulnerability. The use of some of these additives in composite propellent compositions intended for rocket engines is known. Thus, U.S. Pat. No. 3,156,594 describes compositions for rocket engines based on ammonium perchlorate containing lithium fluoride in order to improve the plateau effect of these compositions, that is to say the relative constancy of the rate of combustion in relation to the operating pressure, during combustion. However, so far as the applicant are aware, these additives have never been employed in propellent powders for weapons.

The weight content of additive in the powder according to the invention is generally between 0.5% and 3% relative to all the constituents of the powder; this content will be preferably around 1%.

Lithium fluoride is the preferred additive within the scope of the present invention.

Finally, according to another alternative form of the invention, the additive is used in combination with acetylene black. Within the scope of the present invention "acetylene black" means a carbon black originating from the combustion of acetylene and whose specific surface is around 70 $m^2/g$. It has been observed, however, that, in order that the powder should exhibit property of having both a low vulnerability and good ignition characteristics, the additive must be used in combination with acetylene black to the exclusion of any other similar carbon compound. In particular, within the scope of the present invention it is not possible to use the additive in combination with graphite, even though it is commonly employed as coating agent in the field of manufacture of propellent powders.

The weight content of acetylene black in the powder is generally between 0.05% and 0.5% relative to all the constituents of the powder and is preferably around 0.2%.

The manufacture of the powder is carried out using techniques which are known to a person skilled in the art.

When a binder of thermoplastic type is employed, it may be advantageous to resort to manufacturing techniques known as "with solvents", according to which the binder, the energetic filler, the various adjuvants and the additives according to the invention and optionally carbon black are blended in the presence of solvents such as ether, acetone and ethyl acetate, which may or may not be used in combination with ethanol. The dough thus obtained is then extruded and cut up into particles which are dried before undergoing finishing treatments.

When the binder is a crosslinkable polymer resulting from a polycondensation, it will be possible to employ a screw extruder into which the constituents based on the binder, the energetic filler, the adjuvants, the additives according to the invention and optionally the acetylene black are introduced. As it is crosslinking, the dough is extruded and cut up into particles in which the condensation reaction is completed.

When the binder is a polyurethane obtained from a polyhydroxylated compound which has a functionality higher than 2 it will be advantageously possible to employ the technique described in French Patent 2,577,919 or in its U.S. Pat. No. equivalent 4,657,607.

As stated above, the powders according to the invention exhibit both good ignition characteristics and a very good insensitivity to heat shocks and to impact. When compared with so-called "low vulnerability" powders known hitherto, they exhibit an appreciable improvement in ignition characteristics. However, it has also been observed that, when compared with their homologues of the same composition which do not contain the additives according to the invention, they exhibit a better insensitivity to projectile impacts. This is a wholly surprising finding insofar as it is recognised that the improvement in the ignition of a low-vulnerability powder entails a deterioration in its resistance to impacts and to thermal shocks.

The powders according to the invention thus find their preferential application as propellent powder for ballistic ammunition which must present reduced hazards, in particular ammunition intended for weapons carried aboard armoured vehicles, combat aircraft and fighting ships.

Certain potential implementations of the invention are illustrated with the aid of the examples which follow and are given without any limitation being implied.

EXAMPLE 1

Three powders according to the invention were manufactured in the form of cylindrical particles which have seven holes parallel to the generatrices of the cylinder and which have a web thickness of 1.1 mm.

The compositions of these three powders were the following:

| | |
|---|---|
| Powder A: | |
| hydroxylated polybutadiene of number-average molecular mass around 2800 and of OH hydroxyl group functionality around 0.75 equivalents/kg | 11.2% by weight |
| toluene diisocyanate | 0.9% by weight |
| RDX | 80% by weight |
| dioctyl azelate | 6.3% by weight |
| adjuvants (antioxidants and wetting agents) | 0.6% by weight |
| lithium fluoride | 1% by weight |
| Powder B: | |
| hydroxylated polybutadiene identical with that employed for powder A | 12.7% by weight |
| toluene diisocyanate | 1.1% by weight |
| RDX | 80% by weight |
| dioctyl azelate | 4.3% by weight |
| adjuvants (antioxidants and wetting agents) | 0.9% by weight |
| lithium fluoride | 1% by weight |
| Powder C: | |
| hydroxylated polybutadiene of number-average molecular mass around 2800 and OH hydroxyl group functionality around 0.85 equivalents/kg | 12.4% by weight |
| toluene diisocyanate | 1.3% by weight |
| RDX | 80% by weight |
| dioctyl azelate | 4.3% by weight |
| adjuvants (antioxidants and wetting agents) | 1.0% by weight |
| lithium fluoride | 1% by weight |

These powders were subjected to the so-called "hot ball" test known internationally as the "Hot Fragment Conductive Ignition Test" or HFCIT.

To perform this test, a calibrated ball heated to a defined temperature falls on a bed of particles of propellent powder. For each ball size the tests define the limiting temperature above which the powder ignites or reacts. This test thus simulates the resistance of the powder to the impact of a projectile.

FIG. 1 shows, using a finely broken line, the curve of average limit of temperature as a function of the mass of the ball for the three powders according to the invention. Also shown therein is the curve corresponding to a reference powder R whose composition is identical with that of powder A except for the lithium fluoride, which it does not contain, as well as the curve corresponding to a traditional powder Z with a simple nitrocellulose base with an energy output of 3,640 joules/g, that is 870 cal/g.

The particle geometry of powder R and Z was identical with that of the particles of powder A, B and C according to the invention.

It is seen that powders A, B, C and R exhibit an impact insensitivity which is superior to that of a traditional nitrocellulose powder and that a considerable increase in the temperature limit is obtained in the case of powders A, B and C according to the invention when compared with powder R which does not contain any lithium fluoride, this increase being of the order of 100° C. in the case of balls of average size.

Furthermore, a standard ignitability (S.I.) was measured on powder A according to the invention and on powder R containing no lithium fluoride.

To measure this standard ignitability the powder is evaluated in a bomb of 70-$cm^3$ capacity fitted with a pressure sensor. A receptacle containing the ignition product, generally black powder, and closed by a calibrated bursting disc, is installed at one end of the bomb. The opposite end of the bomb is covered with the particles of the powder to be tested. These particles are stuck side by side in a single row. The axis of the particles is parallel to that of the bomb. The pressure prevailing in the bomb is recorded throughout the test. From it is calculated an ignition period "t1", the time after which the pressure in the chamber begins to rise under the effect of the beginning of combustion of the powder being tested, and an ignition period "t2" at the end of which the pressure rise due to the gases from combustion of the powder being tested reaches 2 MPa.

The results were as follows:

| | | |
|---|---|---|
| Powder R: | t1 = 111 ms, | t2 = 258 ms |
| Powder A: | t1 = 50 ms, | t2 = 114 ms |

It is thus seen that powder A according to the invention, when compared with its additive-free homologue, not only has an improved insensitivity to impacts but also ignition periods which are much shorter, and this reflects greatly superior ignition characteristics.

EXAMPLE 2

10-mm edge cubes were produced from a certain number of powder compositions.

Composition D: analogous to the composition of powder A of Example 1,

Composition E: analogous to the composition of powder A of Example 1, lithium fluoride being replaced with lithium nitrate, Composition F: analogous to the composition of powder A of Example 1, lithium fluoride being replaced with ammonium fluoride, Composition X: analogous to the composition of powder R of Example 1; this composition therefore does not contain any additive according to the invention, Composition G: analogous to the composition of powder A of Example 1, but the hydroxylated polybutadiene is replaced with a hydroxylated polyglycidylazide of molecular mass 2000.

The hot ball test was performed on these cubes and, furthermore, their standard ignitability (S.I.) was measured as described in Example 1.

The results were as follows:

| Hot ball test (limiting temperature) | | |
|---|---|---|
| | 0.13 g ball | 6 g ball |
| composition D: | 600° C. | 300° C. |
| composition E: | 500° C. | 300° C. |
| composition F: | 575° C. | 325° C. |
| S.I. | | |
| composition X: | t1 = 419 ms | t2 > 735 ms |
| composition D: | t1 = 208 ms | t2 = 358 ms |

-continued

| Hot ball test (limiting temperature) | | |
|---|---|---|
| | 0.13 g ball | 6 g ball |
| composition E: | t1 = 102 ms | t2 = 233 ms |
| composition F: | t1 = 198 ms | t2 = 419 ms |
| composition G: | t1 = 82 ms | t2 = 165 ms |
| composition Go: | t1 = 84 ms | t2 = 181 ms |

Composition Go is identical with composition G but does not contain any lithium fluoride.

From these various tests it emerges that the additives according to the invention make it possible to improve the resistance to impacts and the ignitability of the various low-vulnerability powders known hitherto, their effect being less sensitive, however, in the case of highly energetic powders such as the powders with a binder based on polyglycidyl azide (compositions G and Go).

EXAMPLE 3

2 powders were manufactured, with geometry analogous to that of Example 1, having cellulose acetobutyrate as binder. The solvent for manufacture was ethyl acetate. The compositions were the following:

| | Composition H | Composition Ho |
|---|---|---|
| cellulose acetobutyrate | 11.4% by weight | 12% by weight |
| acetyl triethylcitrate | 7.2% by weight | 7.6% by weight |
| centralite | 0.4% by weight | 0.4% by weight |
| nitrocellulose | 4% by weight | 4% by weight |
| RDX | 76% by weight | 76% by weight |
| lithium fluoride | 1% by weight | none |

The hot ball test was carried out on these powders and, furthermore, their standard ignitability (S.I.) was measured as described in Example 1.

The results were as follows:

| Hot ball test (limiting temperature) | | |
|---|---|---|
| | 0.13 g ball | 6 g ball |
| powder H | >775° C. | 450° C. |
| powder Ho | >700° C. | not measured |
| S.I. | | |
| powder H | t1 = 67 ms | t2 = 135 ms |
| powder Ho | t1 = 118 ms | t2 = 250 ms |

It is thus seen that powder H according to the invention, when compared with its additive-free homologue Ho, exhibits an insensitivity to impacts which is slightly improved and ignition periods which are much shorter, reflecting greatly superior ignition characteristics.

EXAMPLE 4

Two powders according to the invention were employed in a 105 calibre arrow shell ammunition.

Powder J: analogous to powder A of Example 1 but presented in the form of cylindrical particles with 19 holes, each 0.3 mm in diameter. The powder particles have a 1.5-mm web thickness and an aspect ratio (ratio of their length to their diameter) of 1.57.

Powder K: identical with powder J, but this powder additionally contains, in its bulk, 0.2% by weight of acetylene black, the percentages being expressed in relation to the weight of all the constituents of the powder. The ammunition was filled with 5.6 kg of powder. The firing results were as follows:

maximum pressure in the weapon:

powder J: 320 MPa powder K: 470 MPa projectile velocity at barrel exit:

powder J: 1 342 m/s powder K: 1 509 m/s.

It can thus be seen that the incorporation of an acetylene black in a powder according to the invention further improves the ballistic performance of the projectile, reflecting an improvement in the ignitability of the powder.

We claim:

1. A low vulnerability ammunition propellant composition for ballistic ammunition having resistance to impact and to thermal shocks and good sensitivity to ignition which consists essentially of 1) an energetic filler which is a member selected from the group consisting of cyclotrimethylene trinitramine, cyclotetramethylene tetranitramine, nitroguanidine and triaminoguanidine nitrate, 2) an organic polymer which is an inert or energetic binder, the ratio by weight of said binder to said energetic filler being about 20:80, and 3) at least one additive which is a member selected from the group consisting of lithium fluoride, ammonium fluoride and lithium nitrate in the amount of 0.5–3% by weight of said composition.

2. The composition according to claim 1 wherein said ballistic ammunition is intended for use aboard armoured vehicles, combat aircraft and fighting ships.

3. The composition according to claim 1, wherein said inert binder is a polyurethane obtained from a polybutadiene containing hydroxyl groups, a polyester or a thermoplastic cellulose derivative.

4. The composition according to claim 3, wherein said thermoplastic cellulose derivative is cellulose acetobutyrate.

5. The composition according to claim 1, wherein said energetic binder is a polyurethane obtained from glycidyl azide polymers or copolymers.

6. The propellant according to claim 1, wherein said at least one additive is lithium fluoride.

7. A low vulnerability ammunition propellant composition for ballistic ammunition having resistance to impact and to thermal shocks and good sensitivity to ignition which consists essentially of 1) an energetic filler which is a member selected from the group consisting of cyclotrimethylene trinitramine, cyclotetramethylene tetranitramine, nitroguanidine and triaminoguanidine nitrate; 2) an organic polymer which is an inert or an energetic binder, the ratio by weight of said binder to said energetic filler being about 20:80; and 3) at least one additive which is a member selected from the group consisting of lithium fluoride, ammonium fluoride and lithium nitrate in the amount of 0.5–3% by weight of said powder together with acetylene black in the amount of 0.05–0.5% by weight with respect to said composition.

8. The composition according to claim 7 wherein said ballistic ammunition is intended for use aboard armoured vehicles, combat aircraft and fighting ships.

9. The propellant according to claim 7, wherein said at least one additive is lithium fluoride.

* * * * *